US007594722B2

(12) United States Patent
Kadomatsu et al.

(10) Patent No.: US 7,594,722 B2
(45) **Date of Patent: *Sep. 29, 2009**

(54) IMAGE FORMING APPARATUS AND METHOD

(75) Inventors: Tetsuzo Kadomatsu, Kanagawa (JP); Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 352 days.

This patent is subject to a terminal disclaimer.

(21) Appl. No.: 11/341,690

(22) Filed: Jan. 30, 2006

(65) Prior Publication Data

US 2006/0170752 A1 Aug. 3, 2006

(30) Foreign Application Priority Data

Jan. 31, 2005 (JP) ..... 2005-024125

(51) Int. Cl.
*B41J 2/01* (2006.01)

(52) U.S. Cl. ..... 347/105; 347/21; 347/96; 347/100; 347/101; 347/103; 428/195.1; 523/160; 523/161

(58) Field of Classification Search ..... None
See application file for complete search history.

(56) References Cited

U.S. PATENT DOCUMENTS

| | | | | |
|---|---|---|---|---|
| 5,640,187 | A | 6/1997 | Kashiwazaki et al. | |
| 5,948,512 | A | 9/1999 | Kubota et al. | |
| 6,232,370 | B1 | 5/2001 | Kubota et al. | |
| 6,412,934 | B1 * | 7/2002 | Moriyama et al. | 347/96 |
| 6,485,138 | B1 | 11/2002 | Kubota et al. | |
| 6,538,047 | B1 * | 3/2003 | Miyabayashi | 523/160 |
| 6,682,189 | B2 * | 1/2004 | May et al. | 347/103 |
| 2006/0066662 | A1 * | 3/2006 | Kadomatsu et al. | 347/21 |
| 2006/0170726 | A1 * | 8/2006 | Hirakawa | 347/21 |
| 2006/0268085 | A1 * | 11/2006 | Konno | 347/100 |
| 2008/0074462 | A1 * | 3/2008 | Hirakawa | 347/28 |

FOREIGN PATENT DOCUMENTS

| | | | |
|---|---|---|---|
| EP | 0 534 634 | A1 | 3/1993 |
| JP | 5-202328 | A | 8/1993 |
| JP | 6-99576 | A | 4/1994 |
| JP | 9-286940 | A | 11/1997 |
| JP | 11-348255 | A | 12/1999 |
| JP | 2001-179959 | A | 7/2001 |
| JP | 2004-90596 | A | 3/2004 |

* cited by examiner

*Primary Examiner*—Matthew Luu
*Assistant Examiner*—John P Zimmermann
(74) *Attorney, Agent, or Firm*—Birch, Stewart, Kolasch & Birch, LLP

(57) ABSTRACT

The image forming apparatus includes: a treatment liquid application device which applies treatment liquid onto a recording medium, the treatment liquid containing cationic polymer and a coloring material aggregating agent; an ink liquid ejection device which ejects droplets of ink liquid toward the recording medium, the ink liquid having anionic properties and containing a solvent and a coloring material which aggregates due to reaction with the coloring material aggregating agent; and a solvent absorbing device which absorbs the solvent on the recording medium in a state where an aggregate of the coloring material and the solvent are separated after a first reaction in which a film is formed at a liquid interface between the treatment and ink liquids on the recording medium by mixing treatment and ink liquids and a second reaction in which the aggregate of the coloring material in the ink liquid is formed after film formation.

6 Claims, 11 Drawing Sheets

IMAGE FORMING APPARATUS AND METHOD

BACKGROUND OF THE INVENTION

1. Field of the Invention

The present invention relates to an image forming apparatus and method, and more particularly, to image forming technology suitable for an inkjet recording apparatus which forms images on a recording medium by ejecting liquid droplets from nozzles.

2. Description of the Related Art

An inkjet type of image forming apparatus records text and images (hereinafter, generally called an "image") by means of dots of ink deposited on a recording medium such as a recording paper, by ejecting ink droplets from nozzles of a print head.

Japanese Patent Application Publication No. 2004-90596 discloses an image forming apparatus which comprises a device which applies a liquid for hydrophilizing the recording surface of the medium, a device which applies a liquid for raising the viscosity of the ink onto the recording surface which has been hydrophilized, and a device for an image formed by ejecting ink after applying the viscosity-raising liquid. This apparatus is proposed with a view to forming a desirable image without the occurrence of defects, such as beading (i.e., ink repulsion and combination defects) and bleeding (i.e., color mixing defects), on various types of non-absorbent recording surface which do not have ink-absorbing properties, a typical embodiment of which is an OHP sheet.

In respect of image forming methods using ink containing a coloring agent (coloring material) such as dye or pigment, and a reactive liquid (treatment liquid) containing a compositional material having the property of reacting with compositional material of the ink, various methods have been proposed (for example, see Japanese Patent Application Publication Nos. 2001-179959, 6-99576, 5-202328, 9-286940 and 11-348255).

Japanese Patent Application Publication No. 2001-179959 discloses an image apparatus in which a solvent absorbing body having a surface with good separating properties with respect to the ink coloring material is made to contact ink on a medium, thereby absorbing the solvent (the solvent of the ink remaining on the recording medium after printing, and especially the liquid solvent (generally, water) which is the main component of the ink). This apparatus prevents the image on one sheet from transferring another sheet when a plurality of sheets of recording medium are printed. Furthermore, Japanese Patent Application Publication No. 2001-179959 also discloses a composition in which, the coloring material in the ink is converted into particles by using an aggregation promoter which causes the coloring material (dye or pigment) in the ink to aggregate and deposit, and the solvent absorbing body is placed in contact with the ink in a state where the coloring material and the liquid solvent have separated into different phases, thereby absorbing the solvent only.

Japanese Patent Application Publication No. 6-99576 discloses an inkjet recording method in which a solution containing a polymer having opposite polarity to that of the polymer contained in the recording liquid (ink) is sprayed onto the recording medium before recording, and an image is then recorded by ejecting the recording liquid onto the portion where liquid droplets of the solution have been applied. This method is proposed with a view to ensuring good printing quality on various different types of recording paper, as well as obtaining a recorded image having excellent durability, such as scratch resistance, water resistance, light resistance, and the like.

Moreover, technologies for causing the coloring material to aggregate by using a multivalent metallic salt solution are known (see Japanese Patent Application Publication Nos. 5-202328, 9-286940, and 11-348255). Japanese Patent Application Publication No. 11-348255, for example, discloses a method that obtains a good image by changing the amount of reactive liquid according to the droplet ejection sequence of the ink liquid and the reactive liquid.

Although Japanese Patent Application Publication No. 2004-90596 proposes the use of two types of treatment liquid in order to prevent beading and bleeding, it does not provide any disclosure regarding the processing (removal) of the solvent remaining on the media. Japanese Patent Application Publication No. 2001-179959, on the other hand, describes technology for absorbing and removing solvent from the media; however, it does not mention technology for avoiding landing interference.

Landing interference is a phenomenon that occurs when ink droplets combine on the surface of the recording medium immediately after landing, thus deforming the original independent shapes of the droplets and disrupting the shapes of the dots. Concerning inks of different colors, the problem of color mixing can occur when the inks of different colors interfere with each other in sections where the dots were not supposed to have overlapped. Even in the case of ink of the same color, the prescribed dot shape (for example, an ideal circular shape) is lost, and hence the image is degraded. Especially, the landing interference is important in cases where droplets are ejected to form mutually adjacent dots at short time intervals (at high speed).

Japanese Patent Application Publication Nos. 6-99576, 5-202328, 9-286940, and 11-348255 provide disclosures relating to the composition of the ink liquid and the treatment liquid (reactive liquid). However, they do not discuss the avoidance of landing interference, the separation of the coloring material and solvent, and the processing of the solvent once separated.

SUMMARY OF THE INVENTION

The present invention has been contrived in view of the foregoing circumstances, an object thereof being to provide an image forming apparatus and method that are capable of avoiding landing interference and/or removing solvent swiftly and reliably from a medium.

In order to attain the aforementioned object, the present invention is directed to an image forming apparatus. The image forming apparatus comprises: a treatment liquid application device which applies treatment liquid onto a recording medium, the treatment liquid containing cationic polymer and a coloring material aggregating agent; an ink liquid ejection device which ejects droplets of ink liquid toward the recording medium, the ink liquid having anionic properties and containing a solvent and a coloring material which aggregates due to reaction with the coloring material aggregating agent; and a solvent absorbing device which absorbs the solvent on the recording medium in a state where an aggregate of the coloring material and the solvent are separated after a first reaction in which a film is formed at a liquid interface between the treatment liquid and the ink liquid on the recording medium by mixing the treatment liquid and the ink liquid and a second reaction in which the aggregate of the coloring material in the ink liquid is formed after formation of the film.

According to this aspect of the present invention, when the treatment liquid and the ink liquid mix together on the recording medium, the film is formed at the liquid interface due to the chemical reaction (the first reaction) between the cationic polymer in the treatment liquid and the anionic material in the ink liquid (the coloring material having an anionic base, an anionic polymer added to the ink liquid, or the like). The film formed in this first reaction prevents the unification of mutually adjacent dots and the movement of the ink on the recording medium.

Furthermore, following this first reaction, or in parallel with same, the reaction (the second reaction) due to the coloring material aggregating agent progresses and the coloring material in the ink liquid aggregates to generate a coloring material aggregate. In the reaction for creating the aggregate of the coloring material, it is possible to use a reaction which produces the aggregate by breaking down the dispersed state of a pigment due to change in the pH, or a reaction between a multivalent metal and coloring material (pigment or dye). By using the reactions of those kinds, it is possible to reliably separate the coloring material from the solvent, without any coloring material remaining in the solvent.

In this way, the coloring material aggregate and the solvent in the liquid ink droplets on the recording medium separate, and the solvent is absorbed by the solvent absorbing device while the liquid ink is in this separated state. In this case, since the film is formed around the periphery of the dots, the motion of the coloring material is limited when the solvent is absorbed by the solvent absorbing device (it is possible to prevent adherence of the coloring material to the solvent absorbing device), and hence disturbance of the image is prevented.

In this way, according to this aspect of the present invention, by using the two reactions, it is possible to prevent disturbance of the image and to eliminate the solvent from the recording medium swiftly and reliably, as well as avoid landing interference.

The treatment liquid application device according to this aspect of the present invention may be a device which ejects treatment liquid in the form of liquid droplets by using an inkjet type ejection head; a device which applies the treatment liquid by means of a roller, a brush, a blade-shaped member, a porous member, or the like; a device which applies a treatment liquid by spraying a mist; or a suitable combination of these.

For the ink liquid ejection device, it is suitable to use an inkjet type of ejection head that ejects ink liquid on the basis of image information for printing (print data).

A configuration example of the ink liquid ejection head in the image forming apparatus of the present invention is a full line type inkjet head having a nozzle row in which a plurality of nozzles (ejection ports) are arranged through a length corresponding to the full width of the recording medium. In this case, a mode may be adopted in which a plurality of relatively short ejection head modules having nozzles rows each of which do not reach a length corresponding to the full width of the recording medium are combined and joined together, thereby forming a nozzle row of a length that corresponds to the full width of the recording medium as a whole.

A full line type inkjet head is usually disposed in a direction perpendicular to the relative feed direction (relative conveyance direction) of the recording medium. A mode may also be adopted in which the inkjet head is disposed in an oblique direction that has a prescribed angle with respect to the direction perpendicular to the relative conveyance direction.

Furthermore, in order to form a color image, it is possible to provide full line type recording heads for respective colors of a plurality of colored inks (recording liquids), or it is possible to eject recording inks of a plurality of colors from one recording head.

Modes of the conveyance device for causing the recording medium and the ink liquid ejection head to move relatively to each other may include a mode where the recording medium is conveyed with respect to a stationary (fixed) head, a mode where a head is moved with respect to a stationary recording medium, and a mode where both the head and the recording medium are moved.

The "recording medium" indicates a medium on which an image is recorded by liquid ejected from the ink liquid ejection head (recording head) (this medium may also be called a print medium, image forming medium, image receiving medium, media, or the like). The recording medium includes various types of media, irrespective of material and size, such as continuous paper, cut paper, seal paper, a resin sheet such as OHP sheet, film, cloth, a printed circuit board on which a wiring pattern or the like is formed, an intermediate transfer medium, and the like.

Preferably, the solvent absorbing device has a surface made of a porous member.

By adopting a composition in which the surface of the solvent absorbing device that makes contact with the separated solvent is made of a porous member, it is possible to absorb the solvent on the recording medium more rapidly by capillary action. Although there are no particular restrictions on the form of the porous member, desirably, it has the form of a roller or a belt. The roller-shaped or belt-shaped absorbing member is capable of absorbing the solvent on the recording medium while the absorbing member rotates in such a manner that the relative speed of the absorbing member with respect to the recording medium is zero, and thus it is possible to prevent image deterioration due to rubbing between the recording surface and the absorbing member.

Preferably, the image forming device further comprises a conveyance device which conveys at least one of the ink liquid ejection device and the recording medium in such a manner that the recording medium is relatively moved in a relative movement direction with respect to the ink liquid ejection device, wherein: the treatment liquid application device, the ink liquid ejection device, and the solvent absorbing device are disposed in this order, from an upstream side to a downstream side in the relative movement direction; and the ink liquid ejection device and the solvent absorbing device are disposed a required distance apart in such a manner that a time period from landing time of the ink liquid on the recording medium until contact time between the solvent of the ink liquid and the solvent absorbing device, is greater than a time period from the landing time of the ink liquid on the recording medium until completion time of separation of the coloring material and the solvent by the second reaction, when the recording medium is relatively moved with respect to the ink liquid ejection device at a prescribed relative speed by the conveyance device.

According to this aspect, the conditions relating to the interval between the positions of the ink liquid ejection device and the solvent absorbing device, and the conveyance speed (relative movement speed) achieved by the conveyance device are set, in such a manner that the reaction time until the separation reaction between the coloring material and the solvent has completed is ensured. Accordingly, it is possible to reliably remove the separated solvent, and beneficial effects in preventing smearing, preventing bleeding between colors, promoting drying and fixing, preventing cockling (undulation or wrinkling of the surface of the recording medium caused by permeation of solvent into the recording medium), and the like can be obtained.

Preferably, the image forming apparatus further comprises a first voltage application device which applies a first voltage to the solvent absorbing device, wherein: the aggregate of the coloring material is charged by reaction between the treatment liquid and the ink liquid; and the first voltage application device applies the first voltage of same polarity as that of the aggregate of the coloring material, to the solvent absorbing device.

As a method for charging the coloring material aggregate positively or negatively, it is possible to adopt a mode in which the composition of the ink liquid and/or the treatment liquid is adjusted in such a manner that anionic or cationic base remains on the surface of the coloring material aggregate, or a mode in which the surface potential of the coloring material is controlled by means of a pH adjuster.

By applying a voltage of the same polarity as the charged coloring material aggregate to the solvent absorbing device, an electrostatic force of repulsion acts, and it is possible to prevent the coloring material from adhering to the solvent absorbing device when the solvent is absorbed by the solvent removing device. Consequently, it is possible to prevent image deterioration and to remove the solvent from the ink on the recording medium swiftly and reliably.

Preferably, the image forming apparatus further comprising: a medium supporting member which supports the recording medium from a face on opposite side to a recording face of the recording medium; and a second voltage application device which applies a second voltage of opposite polarity to that of the aggregate of the coloring material, to the medium supporting member.

According to this aspect, the charged coloring material aggregate is drawn toward the recording medium supported by the medium supporting member charged inversely to the charged coloring material aggregate. Hence, effects in promoting the sinking of the coloring material aggregate and suppressing the movement (adherence) of the coloring material aggregate toward the solvent absorbing device, can be obtained. Thereby, it is possible to enhance the effects of preventing image deterioration and removing solvent. A conveyance device for conveying the recording medium may be used as the medium supporting member.

The present invention is also directed to an image forming method. The image forming method comprises the steps of: applying treatment liquid containing cationic polymer and a coloring material aggregating agent, onto a recording medium; ejecting droplets of ink liquid toward the recording medium, the ink liquid having anionic properties and containing a solvent and a coloring material which aggregates due to reaction with the coloring material aggregating agent; performing a first reaction in which a film is formed at a liquid interface between the treatment liquid and the ejected ink liquid on the recording medium, by mixing the treatment liquid and the ejected ink liquid; performing a second reaction in which an aggregate of the coloring material in the ink liquid is formed after formation of the film; and absorbing the solvent on the recording medium by means of an absorbing member in a state where the aggregate of the coloring material and the solvent are separated after the first reaction and the second reaction.

According to the present invention, a reaction (first reaction) which creates a film at the liquid interface and a reaction (second reaction) which separates the solvent and coloring material by generating a coloring material aggregate, are caused by mixing the treatment liquid and the ink liquid, and the separated solvent is then absorbed and removed. Therefore, it is possible to prevent landing interference and to remove the solvent efficiently without disturbing the image. Accordingly, it is possible to achieve satisfactory high-speed printing.

BRIEF DESCRIPTION OF THE DRAWINGS

The nature of this invention, as well as other objects and advantages thereof, will be explained in the following with reference to the accompanying drawings, wherein.

DETAILED DESCRIPTION OF THE PREFERRED EMBODIMENTS

First Embodiment

General Composition of Inkjet Recording Apparatus

Figure 1:
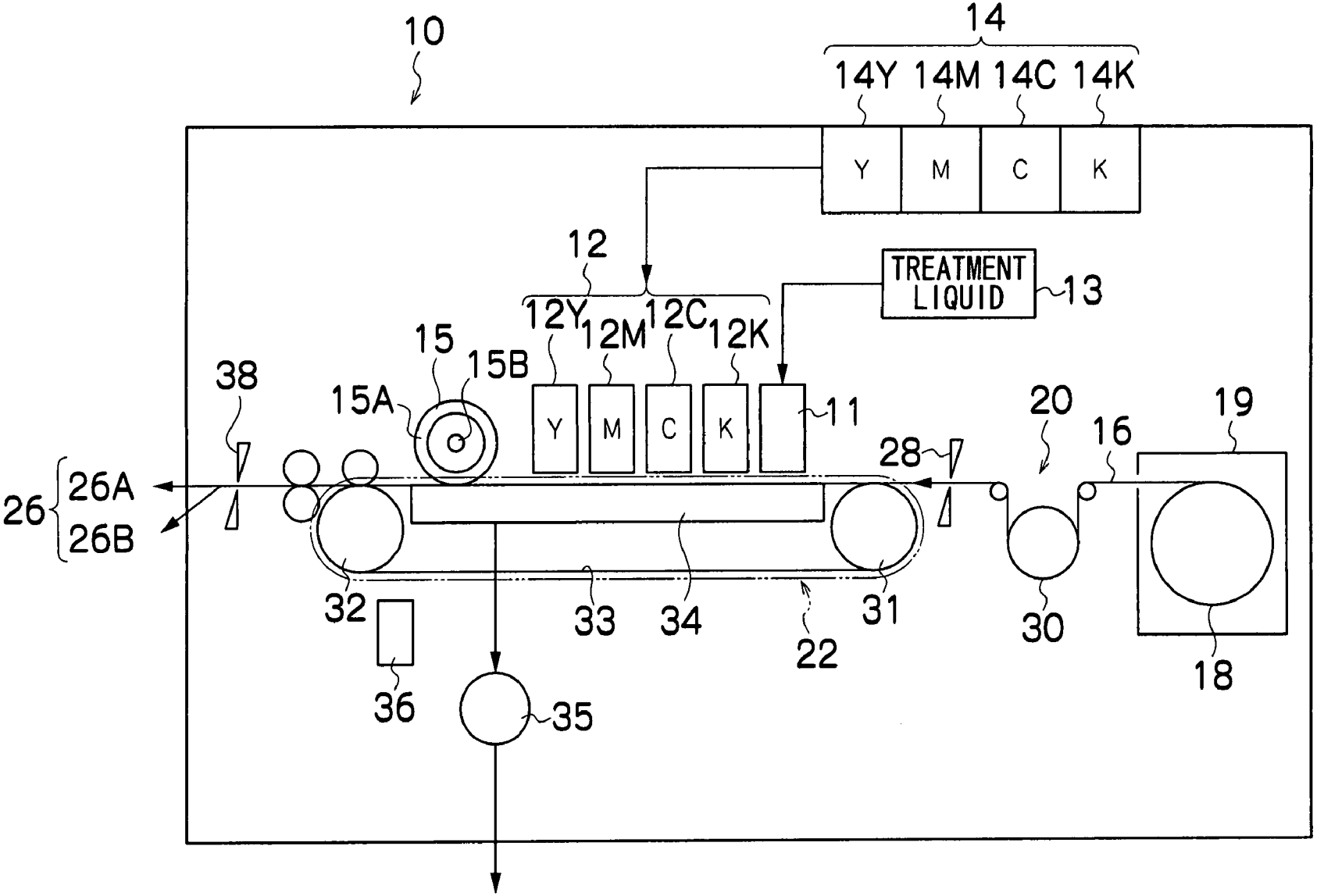
FIG. 1 is a general schematic drawing of an inkjet recording apparatus forming an image forming apparatus according to a first embodiment of the present invention.

FIG. 1 is a general schematic drawing showing an inkjet recording apparatus forming one mode of an image forming apparatus relating to a first embodiment of the present invention. As shown in FIG. 1, this inkjet recording apparatus 10 comprises: a treatment liquid head (corresponding to a treatment liquid application device) 11 for ejecting treatment liquid; a print unit 12 having a plurality of print heads (corresponding to ink liquid ejection devices) 12K, 12C, 12M and 12Y, provided corresponding to respective colors, in order to eject inks of respective colors, namely, black (K), cyan (C), magenta (M), and yellow (Y); a treatment liquid storing and loading unit 13 which stores treatment liquid for supply to the treatment liquid head 11; an ink storing and loading unit 14 which stores colored inks for supply to the print heads 12K, 12C, 12M and 12Y; a solvent-absorbing roller (corresponding to a solvent absorbing device) 15, disposed after the print unit 12; a medium supply unit 18 which supplies a recording medium 16; a decurling unit 20 which removes curl from the recording medium 16; a suction belt conveyance unit (corresponding to a conveyance device) 22, disposed in opposition to the nozzle surfaces (liquid ejection surfaces) of the treatment liquid head 11 and the print unit 12, which conveys the recording medium 16 while keeping the recording medium 16 flat; and a print output unit 26 which outputs recorded recording medium 16 (printed matter) to the exterior.

As regards the supply system for the recording medium 16, in FIG. 1, a magazine 19 for rolled paper (continuous paper) is shown as an example of the medium supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording medium can be used, it is preferable that an information recording medium such as a bar code and a wireless tag containing information about the type of recording medium is attached to the magazine, and by reading the information contained in the information recording medium with a predetermined reading device, the type of recording medium (media type) to be used is automatically determined, and ejection is controlled so that the treatment liquid and ink are ejected in an appropriate manner depending on the type of medium.

The recording medium 16 delivered from the medium supply unit 18 retains curl due to having been loaded in the magazine 19. In order to remove the curl, heat is applied to the recording medium 16 in the decurling unit 20 by a heating drum 30 in the direction opposite to the curl direction in the magazine. In this case, the heating temperature is preferably controlled in such a manner that the medium has a curl in which the surface on which the print is to be made is slightly rounded in the outward direction.

In the case of the configuration in which roll paper is used, a cutter (a first cutter) 28 is provided as shown in FIG. 1, and the continuous paper is cut to a desired size by the cutter After decurling in the decurling unit 20, the cut recording medium 16 is delivered to the suction belt conveyance unit 22. The suction belt conveyance unit 22 has a configuration in which an endless belt 33 is set around rollers 31 and 32 so that The portion of the endless belt 33 facing at least the nozzle face of the printing unit 12 forms a horizontal plane (flat plane).

The belt 33 has a width that is greater than the width of the recording medium 16, and a plurality of suction apertures (not shown) are formed on the belt surface. A suction chamber 34 is disposed in a position facing the nozzle surface of the printing unit 12 on the interior side of the belt 33 which is set around the rollers 31 and 32; and the suction chamber 34 provides suction with a fan 35 to generate a negative pressure, thereby holding the recording medium 16 onto the belt 33 by suction.

The belt 33 is driven in the counterclockwise direction in FIG. 1 by the motive force of a motor (indicated by reference numeral 88 in FIG. 7) being transmitted to at least one of the rollers 31 and 32, which the belt 33 is set around, and the recording medium 16 held on the belt 33 is conveyed from right to left in FIG. 1.

Instead of a suction belt conveyance unit 22, it might also be possible to use a roller nip conveyance mechanism. However, since the print region passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable. The attraction method is not limited to attraction by suction (vacuum attraction) as described above, and a method based on electrostatic attraction may also be used.

Since ink adheres to the belt 33 when a marginless print job or the like is performed, a belt cleaning unit 36 is disposed in a predetermined position (a suitable position outside the printing area) on the exterior side of the belt 33. Although the details of the configuration of the belt cleaning unit 36 are not shown, examples thereof may include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

The treatment liquid head 11 and the print heads 12K, 12M, 12C and 12Y are full line heads having a length corresponding to the maximum width of the recording medium 16 used with the inkjet recording apparatus 10 (see FIGS. 2A and 2B), and comprising nozzles for ejecting ink or nozzles for ejecting treatment liquid arranged on a nozzle face through a length exceeding at least one edge of the maximum-size recording paper (the full width of the printable range).

As shown in FIG. 1, the heads 12K, 12C, 12M and 12Y of the print unit 12 are arranged in the sequence of the colors, black (K), cyan (C), magenta (M) and yellow (Y), from the upstream side, in the direction of conveyance of the recording medium 16, and the treatment liquid head 11 is disposed to the upstream side with respect to the print unit 12 (before the print unit 12). The heads 11, 12K, 12C, 12M and 12Y are disposed in fixed positions in such a manner that they extend in a direction substantially perpendicular to the conveyance direction of the recording medium 16.

By means of this head arrangement, it is possible to apply a treatment liquid to the recording surface (print surface) of the recording medium 16 by the treatment liquid head 11, before ejecting droplets of colored inks from the print unit 12. Furthermore, a color image can be formed on the recording medium 16 by ejecting inks of different colors from the print heads 12K, 12C, 12M, and 12Y, respectively, onto the recording medium 16 to which the treatment liquid has been applied, while the recording medium 16 is conveyed by means of the suction belt conveyance unit 22.

By adopting a configuration in which a full line treatment liquid head 11 and full line heads 12K, 12C, 12M and 12Y having nozzle rows covering the full paper width are provided in this way, it is possible to record an image on the full surface of the recording medium 16 by performing just one operation of relatively moving the medium 16 and the printing unit 12, in the paper conveyance direction (the sub-scanning direction), (in other words, by means of one sub-scanning action). Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light and/or dark inks and special color inks can be added as required. For example, a configuration is possible in which print heads for ejecting light-colored inks such as light cyan and light magenta are added. Furthermore, there are no particular restrictions of the sequence in which the heads of respective colors are arranged.

The treatment liquid storing and loading unit 13 has a treatment liquid tank for storing treatment liquid, and the tank is connected to the treatment liquid head 11 via necessary tubing channels. The treatment liquid supplied from the treatment liquid tank is ejected in the form of droplets from the treatment liquid head 11. The treatment liquid storing and loading unit 13 has a reporting device (display device, alarm sound generating device) for issuing a report when the remaining amount of treatment liquid has become low.

The ink storing and loading unit 14 has ink tanks 14K, 14C, 14M, 14Y for storing the inks of the colors corresponding to the print heads 12K, 12C, 12M, and 12Y, and the tanks are connected to the print heads 12K, 12C, 12M, and 12Y through prescribed channels (not shown). The ink storing and loading unit 14 also comprises a warning device (for example, a display device and/or an alarm sound generator) for warning when the remaining amount of any ink is low, and has a mechanism for preventing loading errors among the colors.

The treatment liquid used in the present embodiment may include water serving as a solvent, a surfactant, moisturizer, cationic polymer, and coloring material aggregating agent (for example, a pH adjuster or multivalent metallic salt).

Furthermore, the ink used in the present embodiment includes water serving as the solvent, a coloring material (pigment or dye), surfactant, and moisturizer. It is also possible to include an anionic polymer. In general, the coloring material (pigment or dye) is negatively charged (i.e., produces anions including negative ions) in a solvent (water), and therefore, the pigment or dye itself has reactive properties that cause itself to react with the cationic polymer in the treatment liquid.

As examples of the cationic polymer material included in the treatment liquid, it is possible to use polyarylamine, polyamine sulfone, polyvinylamine, chitosan, or their products formed by the neutralization with an acid.

As a material for the pH adjuster, it is possible to use an acid containing an inorganic acid (hydrochloric acid, sulfuric acid, phosphoric acid, or the like) or an organic acid (desirably, an acid containing carboxylic acid, sulfonic acid, or the like, and more specifically, acetic acid, methansulfonic acid, or the like).

As the multivalent metallic salt, it is possible to use various salts of multivalent metallic ions, such as aluminum, calcium, magnesium, iron, zinc, tin, and the like.

Furthermore, as an example of the anionic polymer material added to the ink according to requirements, it is possible to use polyacrylic acid, shellac, styrene-acrylate copolymer, styrene-maleic anhydride copolymer, or the like.

When the treatment liquid and the ink mix on the recording medium 16, a polymer film is formed at the liquid-liquid interface in a short period of time, due to a chemical reaction between the cationic polymer in the treatment liquid and the anionic substance in the ink (anionic polymer, pigment or dye) (the first reaction). As the reaction progresses further, the coloring material aggregates due to action of the coloring material aggregating agent in the treatment liquid, and the coloring material aggregate sinks toward the recording medium 16 side, thereby separating the coloring material from the solvent (the second reaction).

By adjusting the respective compositions of the treatment liquid and the ink, and the densities of the material contributing to the reaction, it is possible to adjust the reaction speed and the properties of the respective liquids (surface tension, viscosity, and the like). In this way, it is possible to achieve desired reactivity and properties.

The surface of the solvent absorbing roller 15 is made of a porous member 15A which has a length corresponding to the maximum width of the recording medium 16 used in the inkjet recording apparatus 10. The rotational axle 15B of the solvent absorbing roller 15 extends in a direction (main scanning direction) perpendicular to the conveyance direction of the recording medium 16. The solvent absorbing roller 15 supported rotatably on the rotational axle 15B can be rotated in accordance with the conveyance speed of the recording medium 16, in such a manner that the relative speed of the surface of the solvent absorbing roller 15 with respect to the recording medium 16 becomes zero. In this way, disturbance of the image due to rubbing of the ink is prevented.

The solvent absorbing roller 15 may achieve a length corresponding to the full width of the recording medium 16 by means of one (a single) long roller member, and may also achieve the required length by arranging a plurality of roller modules divided in a direction (main scanning direction) substantially perpendicular to the conveyance direction of the recording medium 16. Furthermore, it is possible to adopt a composition in which a plurality of rows of solvent absorbing rollers are disposed in line with the conveyance direction of the recording medium 16.

Although not shown in FIG. 1, an elevator mechanism for raising and lowering the solvent absorbing roller 15 with respect to the recording medium 16 is provided. By controlling the elevator mechanism in accordance with instructions from the system control system described hereinafter, the position of the solvent absorbing roller 15 (the relative position thereof in the direction perpendicular to the recording surface of the recording medium 16) can be adjusted. In this way, it is possible to alter the contact pressure between the solvent absorbing roller 15 and the recording medium 16, or the clearance between the solvent absorbing roller 15 and the recording medium 16. In the case of a composition having a plurality of roller modules, a desirable mode is one in which a mechanism for controlling the vertical position is provided with respect to each roller module.

By moving the recording medium 16 in the direction of conveyance while the solvent absorbing roller 15 is made to contact the ink on the recording medium 16, the solvent on the recording medium 16 (the solvent separated from the coloring material) is absorbed by the solvent absorbing roller 15 due to the capillary force of the porous member 15A. In the ink from which the excess solvent has been removed by the solvent absorbing roller 15 in this way, the coupling force between the coloring materials increases and the coloring materials become fixed onto the recording medium 16.

In the present embodiment, as a device for absorbing and removing the solvent, the solvent absorbing roller 15 comprising the porous member 15A is used. However, the form of the solvent absorbing device is not limited to being roller-form, and it may also be belt-form.

The printed matter generated in this manner (i.e., the resulting matter generated by printing) is outputted from the print output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to print output units 26A and 26B, respectively.

When the target print and the test print are simultaneously formed in parallel on the same large sheet of paper, the test print portion is cut and separated by a cutter (second cutter) 38. The cutter 38 is disposed in front of the print output unit 26, and is used for cutting the test print portion from the target print portion when a test print has been performed in the blank portion of the paper.

Although not shown in FIG. 1, the print output unit 26A for the target prints is provided with a sorter for collecting prints according to print orders.

Structure of Print Head

Next, the structure of the print head will be described. The print heads 12K, 12C, 12M, and 12Y of the respective ink colors have the same structure, and a reference numeral 50 is hereinafter designated to any of the print heads.

Figure 2A:
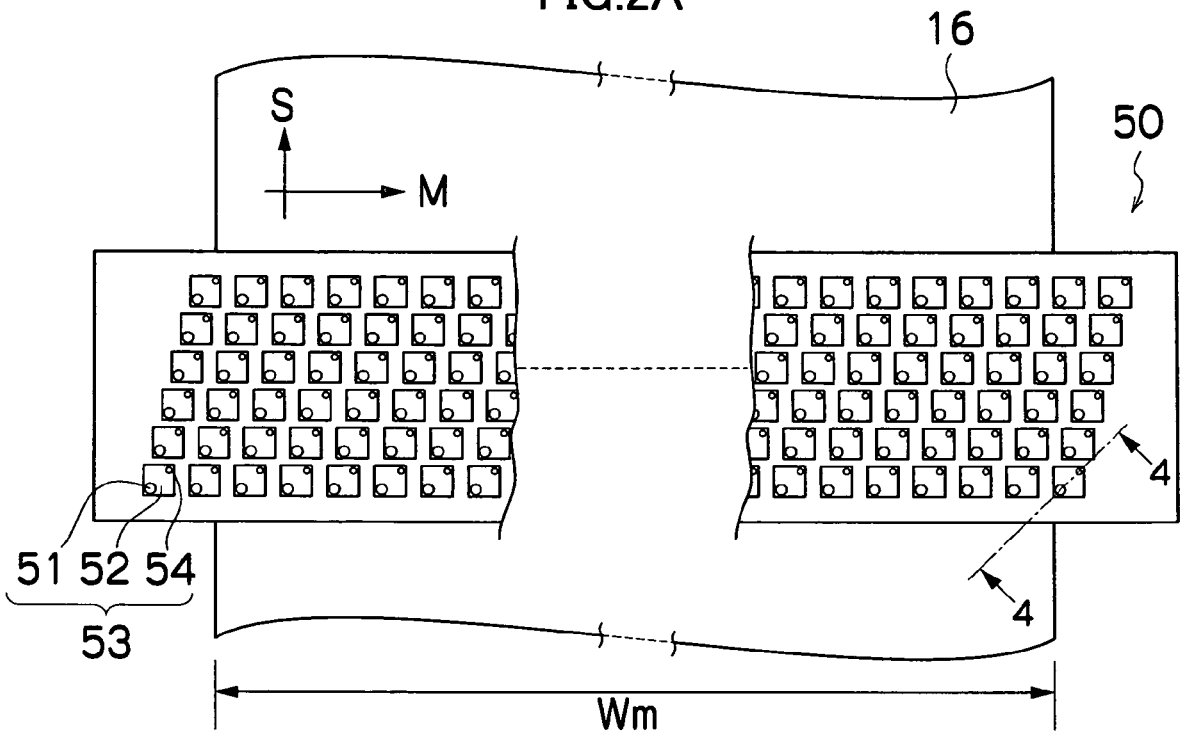
FIGS. 2A and 2B are planar perspective diagrams showing an example of the composition of a print head.
Figure 2B:
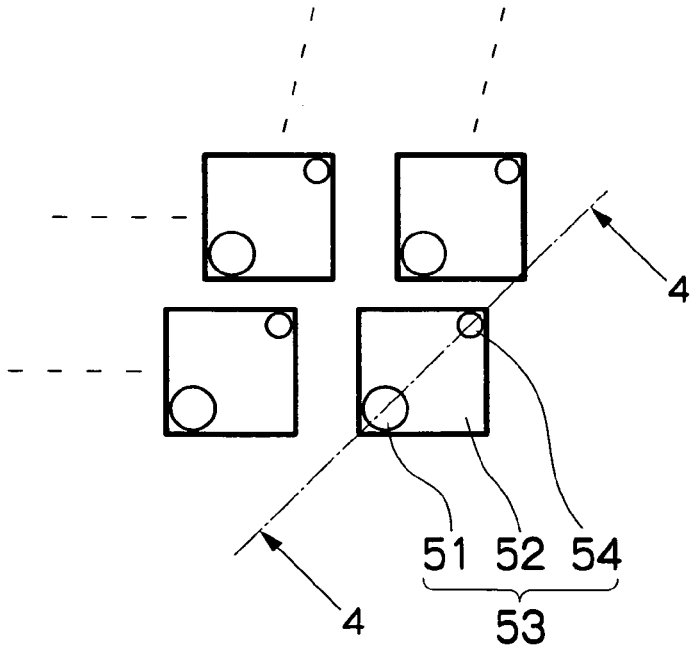
Figure 3:
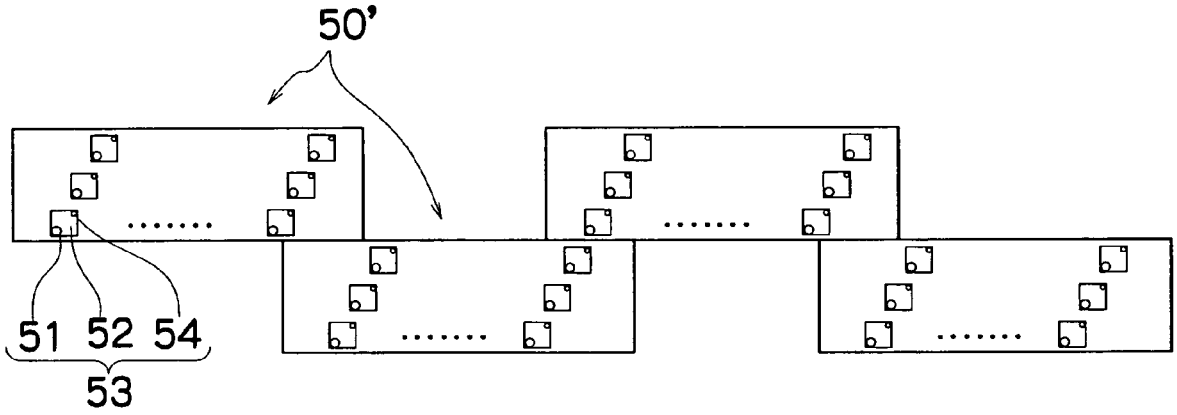
FIG. 3 is a plan view perspective diagram showing a further example of the composition of a full line print head.
Figure 4:
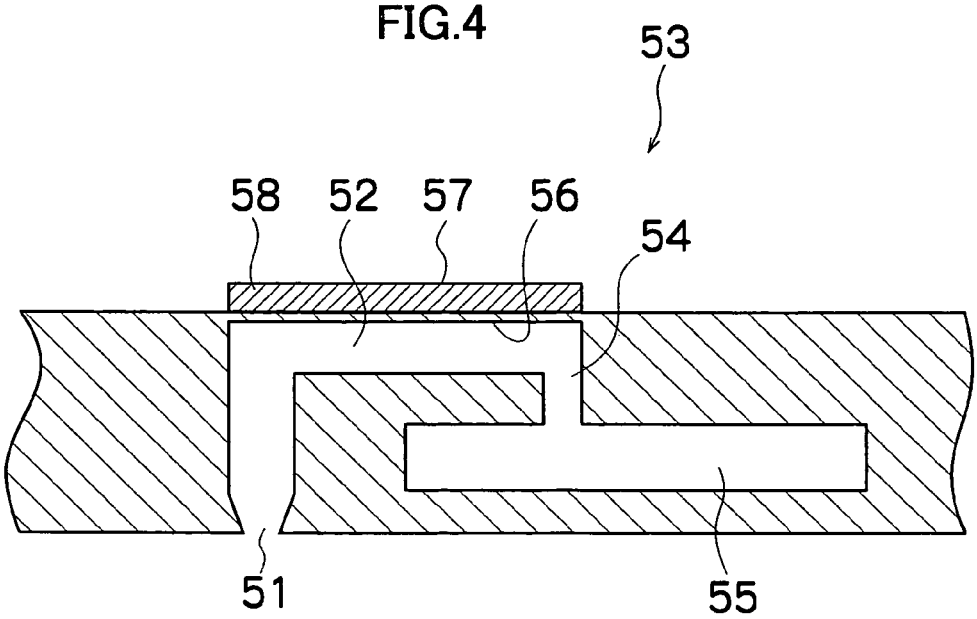
FIG. 4 is a cross-sectional view along line 4-4 in FIGS. 2A and 2B.

FIG. 2A is a perspective plan view showing an example of the configuration of the print head 50, FIG. 2B is an enlarged view of a portion thereof, FIG. 3 is a perspective plan view showing another example of the configuration of the print head 50, and FIG. 4 is a cross-sectional view taken along the line 4-4 in FIGS. 2A and 2B, showing the inner structure of a droplet ejection element (an ink chamber unit for one nozzle 51).

The nozzle pitch in the print head 50 is required to be minimized in order to maximize the density of the dots printed on the surface of the recording medium 16. As shown in FIGS. 2A and 2B, the print head 50 according to the present embodiment includes ink chamber units (droplet ejection elements) 53, each having a nozzle 51 forming an ink droplet ejection port, a pressure chamber 52 corresponding to the nozzle 51, and the like. The ink chamber units 53 are arranged two-dimensionally in the form of a staggered matrix. Hence, the effective nozzle interval (the projected nozzle pitch) resulting from the projection of the nozzles 51 so that the projected nozzles are arranged in the lengthwise direction of the head (the direction perpendicular to the paper conveyance direction) is reduced and high nozzle density is achieved.

The mode of forming one or more nozzle rows through a length corresponding to the entire width Wm of the recording medium 16 in a direction (direction of arrow M: main scanning direction) substantially perpendicular to the conveyance direction of the recording medium 16 (direction of arrow S: sub-scanning direction) is not limited to the examples described above. For example, instead of the configuration in FIG. 2A, as shown in FIG. 3, a line head having nozzle rows of a length corresponding to the entire width of the recording medium 16 can be formed by arranging and combining, in a staggered matrix, short head modules 50' having a plurality of nozzles 51 arrayed in a two-dimensional fashion.

As shown in FIGS. 2A and 2B, the planar shape of the pressure chamber 52 provided for each nozzle 51 is substantially a square, and an outlet to the nozzle 51 and an inlet of supplied ink (supply port) 54 are respectively disposed in both corners on a diagonal line of the square. The shape of the pressure chamber 52 is not limited to the above-mentioned example and various modes are possible in which the planar shape is a polygonal shape such as a quadrilateral shape (rhombic shape, rectangular shape, or the like), a pentagonal shape, and a hexagonal shape, a circular shape, elliptical shape, or the like.

As shown in FIG. 4, each pressure chamber 52 is connected to a common channel 55 through the supply port 54. The common channel 55 is connected to an ink tank 60 (not shown in FIG. 4, but shown in FIG. 6) which is a base tank that supplies ink. The ink supplied from the ink tank 60 is delivered through the common flow channel 55 in FIG. 4 to the pressure chambers 52.

An actuator 58 provided with an individual electrode 57 is bonded to a pressure plate (a diaphragm that also serves as a common electrode) 56 which forms one portion (in FIG. 4, the ceiling) of the pressure chamber 52. When a drive voltage is applied to the individual electrode 57 and the common electrode, the actuator 58 deforms, thereby changing the volume of the pressure chamber 52. This causes a pressure change resulting in ink being ejected from the nozzle 51. As the actuator 58, it is possible to use a piezoelectric element using a piezoelectric material, such as lead zirconate titanate, barium titanate, or the like. When the displacement of the actuator 58 is reduced and the actuator 58 returns to its original position after the ejecting ink, new ink is supplied to the pressure chamber 52 from the common channel 55 via the supply port 54.

Figure 5:
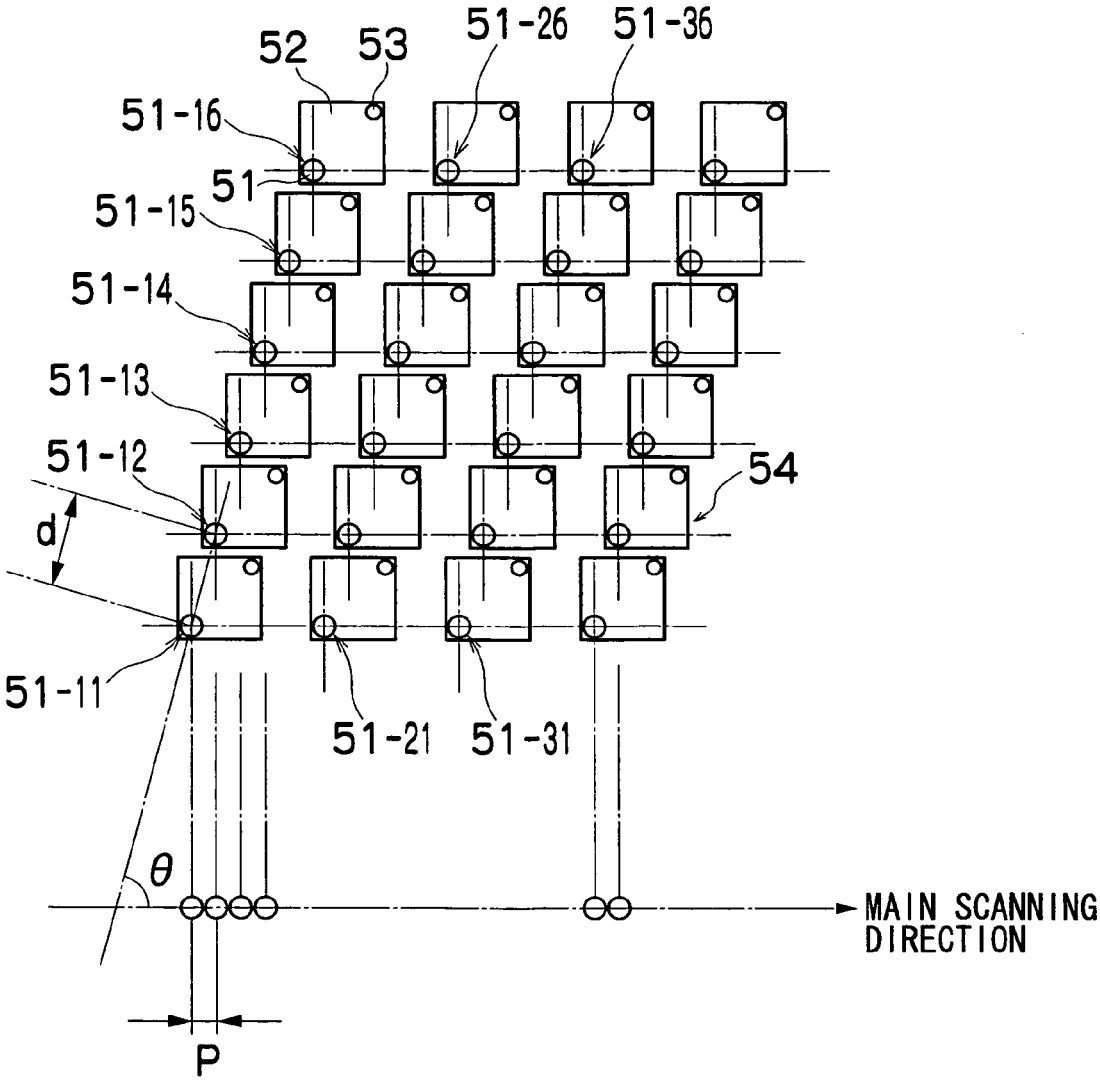
FIG. 5 is an enlarged view showing a nozzle arrangement in the print head shown in FIGS. 2A and 2B.

As shown in FIG. 5, the high-density nozzle head according to the present example is achieved by arranging a plurality of ink chamber units 53 having the above-described structure in a lattice fashion based on a fixed arrangement pattern, in a row direction which corresponds to the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. With such configuration, it is possible to achieve a nozzle row with a high nozzle density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 513-31, . . . , 51-36 are treated as another block; . . . ); and one line is printed in the width direction of the recording medium 16 by sequentially driving the nozzles 51-11, 51-12, . . . , 51-16 in accordance with the conveyance velocity of the recording medium 16.

On the other hand, "sub-scanning" is defined as to repeatedly perform printing of one line (a line formed of a row of dots, or a line formed of a plurality of rows of dots) formed by the main scanning, while the full-line head and the recording paper are moved relatively to each other.

The direction along one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording medium 16 is called the sub-scanning direction and the direction perpendicular to same is called the main scanning direction.

In implementing the present invention, the arrangement of the nozzles is not limited to that of the embodiment illustrated. Although a method is employed in the present embodiment where an ink droplet is ejected by means of the deformation of the actuator 58 typified by a piezoelectric element, the method used for discharging ink is not limited in particular in implementing the present invention. Instead of the piezo jet method, it is also possible to apply various types of methods, such as a thermal jet method where the ink is heated and bubbles are caused to form therein by means of a heat generating body including a heater, ink droplets being ejected by means of the pressure applied by these bubbles.

Although not shown here, the structure of the treatment liquid head 11 is approximately the same as the print head 50 described above. Since it is sufficient that the treatment liquid is applied to the recording medium 16 in a substantially uniform (even) fashion in the region where ink droplets are to be deposited, it is not necessary to form dots to a high density in comparison with the ink. Consequently, the treatment liquid head 11 may have a reduced number of nozzles (a reduced nozzle density) in comparison with the print head 50 for ejecting ink. Furthermore, a composition may also be adopted in which the nozzle diameter of the treatment liquid head 11 is greater than the nozzle diameter of the print head 50 for ejecting ink.

Configuration of Ink Supply System

Figure 6:
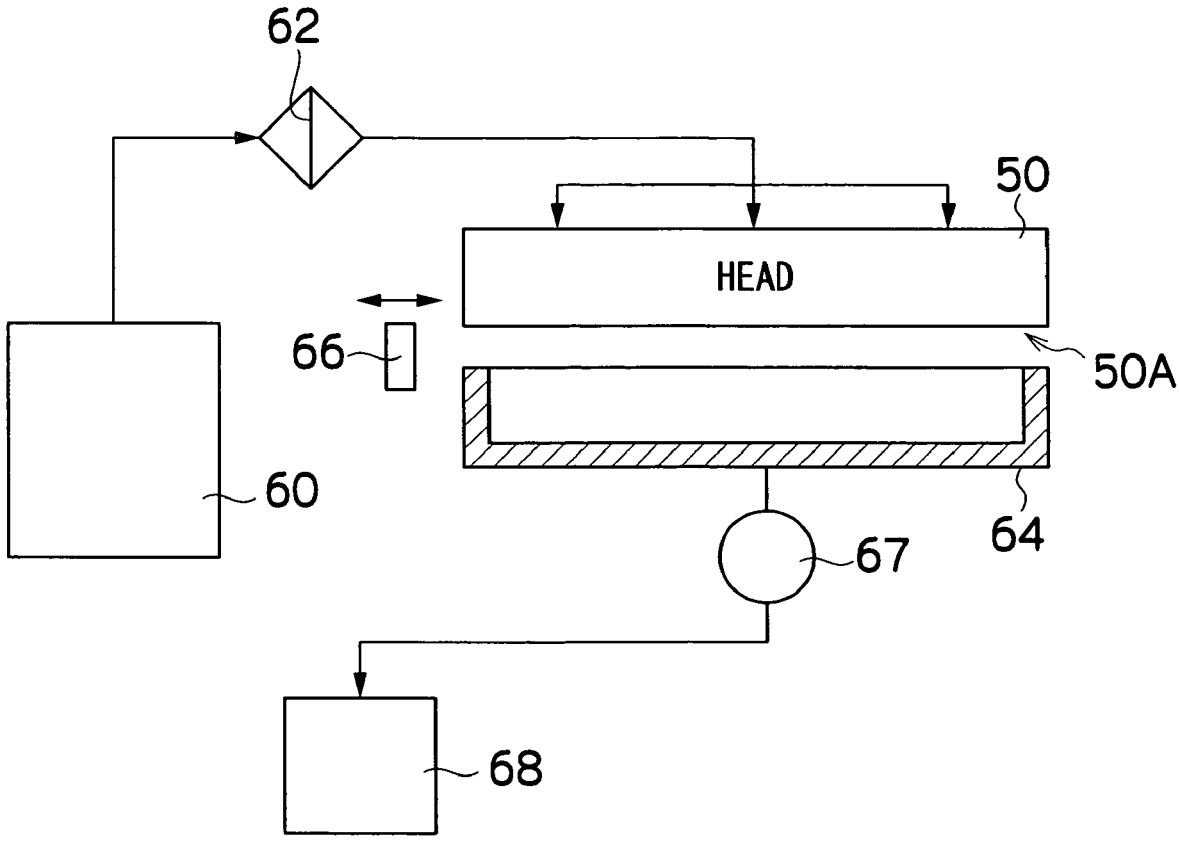
FIG. 6 is a schematic drawing showing the composition of an ink supply system in the inkjet recording apparatus.

FIG. 6 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. In other words, the ink supply tank 60 in FIG. 6 is equivalent to the ink storing and loading unit 14 in FIG. 1. The types of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type depending on the intended application, the cartridge type is suitable, and it is preferable to represent the ink type information with a bar code or the like on the cartridge, and to perform ejection control depending on the ink type.

A filter 62 for removing foreign matters and bubbles is disposed between the ink tank 60 and the print head 50 as shown in FIG. 6. The filter mesh size in the filter 62 is preferably equivalent to or less than the diameter of the nozzle. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoring device) including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the nozzle surface 50A (surface of the nozzle plate) of the print head 50 by means of a blade movement mechanism (not shown). When ink droplets or foreign matter has adhered to the surface of the nozzle plate, the surface of the nozzle plate is wiped by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64 (also used as an ink receptor).

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (i.e., during a state that the viscosity range of the ink allows the ink ejection by the operation of the actuator 58) the actuator 58 is operated to perform the preliminary discharge to eject the ink of which viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, the cap 64 forming a suction device is pressed against the nozzle surface 50A of the print head 50, and the ink inside the pressure chambers 52 (namely, the ink containing air bubbles or the ink of increased viscosity) is suctioned by a suction pump 67. The ink suctioned and removed by means of this suction operation is sent to a recovery tank 68. The ink collected in the recovery tank 68 may be used, or may be discarded if it is impossible to reuse that.

Since the suctioning operation is performed with respect to all of the ink in the pressure chambers 52, it consumes a large amount of ink. Therefore, desirably, preliminary ejection is carried out while the increase in the viscosity of the ink is still minor. The suction operation is also carried out when ink is loaded into the print head 50 for the first time, and when the head starts to be used after being idle for a long period of time.

The supply system for the treatment liquid is not shown; however it is substantially the same as the composition of the ink supply system shown in FIG. 6.

Description of Control System

Figure 7:
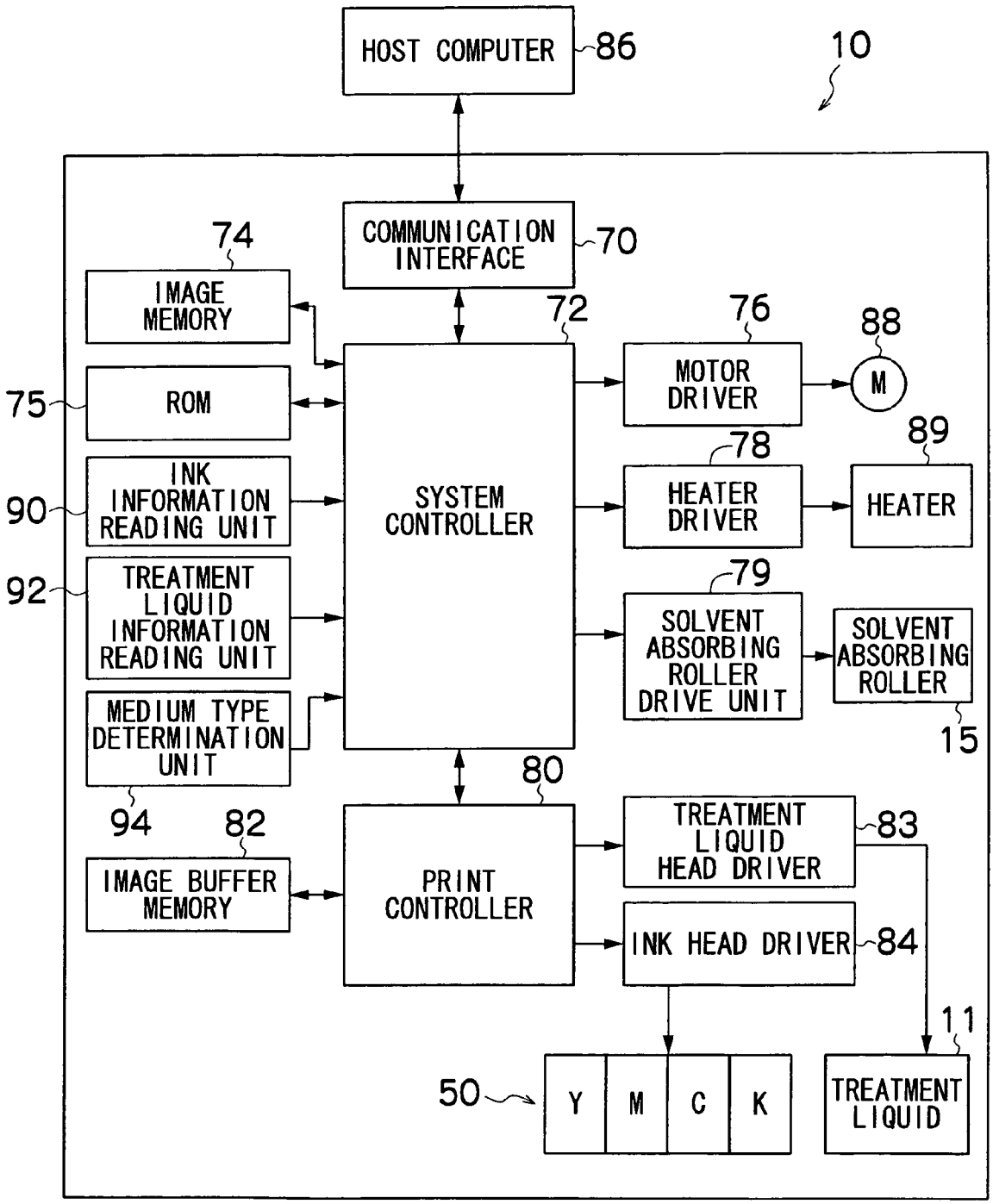
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a solvent absorbing roller drive unit 79, a print controller 80, an image buffer memory 82, a treatment liquid head driver 83, an ink head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used as the image memory.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like. The system controller 72 controls communications with the host computer 86, controls writing and reading to and from the image memory 74, and also generates control signals for controlling the motor 88 and heater 89 of the conveyance system.

The program executed by the CPU of the system controller 72 and the various types of data that are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit or the like in accordance with commands from the system controller 72.

The print controller 80 has a signal processing function for performing various tasks, compensations, and other types of processing for generating print control signals on the basis of the image data stored in the image memory 74 in accordance with commands from the system controller 72 so as to supply the generated print data (dot data) to the treatment liquid head driver 83 and the ink head driver 84.

The image buffer memory 82 is provided in the print controller, and image data, parameters, and other data are temporarily stored in the image buffer memory 82 when image data is processed in the print controller 80. In FIG. 7, the image buffer memory 82 is depicted as being attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed (original image data) is input from an external source via a communications interface 70, and is accumulated in the image memory 74. At this stage, RGB image data is stored in the image memory 74, for example.

In this inkjet recording apparatus 10, an image that appears to have a continuous tonal graduation to the human eye is formed by changing the dot density and the dot size of fine dots created by depositing droplets of the ink (coloring material). Therefore, it is necessary to convert the input digital image into a dot pattern that reproduces the tonal gradations of the image (namely, the light and shade toning of the image) as faithfully as possible. Hence, original image data (RGB data) stored in the image memory 74 is sent to the print controller 80 through the system controller 72, and is converted to the dot data for each ink color by a half-toning technique, such as dithering or error diffusion, in the print controller 80.

In other words, the print controller 80 performs processing for converting the input RGB image data into dot data for the four colors of K, C, M, and Y. Furthermore, the print controller 80 determines the droplet ejection region of the treatment liquid (the region of the recording surface where ejection of treatment liquid is required) on the basis of the dot data of the respective colors, and thus generates dot data for the ejection of treatment liquid droplets. The dot data (for the treatment liquid and the respective colors) generated by the print controller 80 is stored in the image buffer memory 82.

The treatment liquid head driver 83 generates drive control signals for the treatment liquid head 11 on the basis of the dot data for treatment liquid droplet ejection stored in the image buffer memory 82. By supplying the drive control signals generated by the treatment liquid head driver 83 to the treatment liquid head 11, treatment liquid is ejected from the treatment liquid head 11.

Similarly, the ink head driver 84 generates drive control signals for the print head 50 on the basis of the dot data for ink droplet ejection stored in the image buffer memory 82. By supplying the drive control signals generated by the ink head driver 84 to the print head 50, ink is ejected from the print head 50. The treatment liquid head driver 83 and the ink head driver 84 may also each comprise feedback control systems for maintaining uniform drive conditions about the head.

By controlling the ejection of treatment liquid from the treatment liquid head 11 and the ejection of ink from the print head 50 in accordance with the conveyance speed of the recording medium 16, an image is formed on the recording medium 16.

As described above, the ejection volume and the ejection timing of the ink droplets from each nozzle are controlled via the treatment liquid head driver 83 and the ink head driver 84, on the basis of the dot data generated by implementing required signal processing in the print controller 80. By this means, desired dot size and dot arrangement can be achieved.

The inkjet recording apparatus 10 according to this embodiment further includes an ink information reading unit 90, a treatment liquid information reading unit 92, and a medium type determination unit 94. The ink information reading unit 90 is a device for reading in information relating to the ink type. More specifically, it is possible to use, for example, a device which reads in ink identification information or ink properties information from the shape of a cartridge in the ink tank 60 (see FIG. 6) (a specific shape which allows the ink type to be identified), or from a bar code or IC chip incorporated into the cartridge. Besides those, it is also possible that an operator inputs the required information through a user interface.

Similarly, the treatment liquid information reading unit 92 is a device for acquiring information relating to the type of treatment liquid. More specifically, it is possible to use, for example, a device which reads in identification information or properties information relating to the treatment liquid from the shape of the cartridge in the treatment liquid tank (a specific shape which allows the liquid type to be identified), or from a bar code or IC chip incorporated into the cartridge. Besides those, it is also possible that an operator inputs the required information through a user interface.

The medium type determination unit 94 is a device for determining the type and size of the recording medium. This section uses, for example, a device for reading in information (identification information or medium type information) from a bar code attached to the magazine 19 in the medium supply unit 18, or a sensor disposed at a suitable position in the paper conveyance path (such as a medium width determination sensor, a sensor for determining the thickness of the medium, and a sensor for determining the reflectivity of the medium). A suitable combination of these elements may also be used. Furthermore, it is also possible to adopt a composition in which information relating to the paper type, size, or the like, is specified on the basis of inputs made via a prescribed user interface, instead of or in conjunction with such automatic determination devices.

The information acquired from the various devices including the ink information reading unit 90, the treatment liquid information reading unit 92, and the medium type determination unit 94 is sent to the system controller 72, where it is used to control ejection of the treatment liquid and the ink (to control the ejection volume and ejection timing), in such a manner that suitable droplet ejection is performed in accordance with the conditions. More specifically, the system controller 72 determines the permeation speed characteristics of the recording medium 16 on the basis of the information obtained from the respective devices including the ink information reading unit 90, the treatment liquid information reading unit 92, and the medium type determination unit 94. The system controller 72 also determines whether to use a treatment liquid or not, and controls the volume to be ejected if the treatment liquid is to be used.

For example, the inkjet recording apparatus 10 comprises an information storage device (for instance, the ROM 75 shown in FIG. 7, or an internal memory or external memory (not shown)) which stores data for a media type table that associates the media types with the permeation speed characteristics. The system controller 72 determines the permeation speed characteristics of the recording medium 16 used, by referring to this media type table.

As a device for ascertaining the permeation speed characteristics of the recording medium 16, it is possible to obtain the ID (identification information) of the medium from the medium type determination unit 94, and then ascertain the permeation speed characteristics of the media by referring to the media type table. Alternatively, it is possible to record information indicating the permeation speed characteristics of the medium on an information recording body, such as a barcode attached to a magazine, and to then read in the information relating to the permeation speed characteristics of the medium directly from the medium type determination unit 94.

Alternatively, it is also possible to use a device that actually measures the permeation speed of the recording medium 16. For example, ink, treatment liquid, or both ink and treatment liquid are ejected onto the recording medium 16, the state of the dots formed by this test droplet ejection is read in by a determination device (not shown) such as an imaging element, and the permeation speed can be calculated on the basis of the information thus obtained.

As shown in FIG. 1, in the inkjet recording apparatus 10 according to the present embodiment, a composition is adopted in which the treatment liquid head 11 is disposed in an upstream position with respect to the print unit 12, and before ejecting droplets of the ink from the print unit 12, the treatment liquid is previously applied to the print surface of the recording medium 16 by the preceding (upstream) treatment liquid head 11, in a single operation. In the case of this composition, the amount of the treatment liquid on the recording medium 16 gradually declines as the volume of the ink droplets deposited by the print unit 12 increases. Therefore, the further the position toward the downstream side of the print unit 12, the smaller the amount of the treatment liquid remaining on the recording medium 16. It is necessary that some treatment liquid remains on the surface of the recording medium 16 and/or in the vicinity thereof, until droplet ejection by the print head in the final stage (furthest downstream position) of the print unit 12 (in FIG. 1, the yellow head 12Y) has been completed. Therefore, the amount of treatment liquid ejected by the treatment liquid head 11 is determined on the basis of the type of recording medium 16, the properties of the treatment liquid, the ejected ink volume, the conveyance speed of the recording medium 16, and the like, in such a manner that presence of the required amount of treatment liquid can be ensured.

Furthermore, the system controller 72 shown in FIG. 7 controls a solvent absorbing roller drive unit 79 depending on the thickness and permeation speed characteristics of the recording medium 16, and the like, thereby suitably controlling the vertical positioning of the solvent absorbing roller 15 (the contact pressure on the recording medium 16 and/or the clearance with respect to the recording medium 16) and the rotational speed. The solvent absorbing roller drive unit 79 is a device for adjusting the position and rotational speed of the solvent absorbing roller 15 with respect to the recording surface of the recording medium 16. The solvent absorbing roller drive unit 79 comprises an elevator mechanism for moving the solvent absorbing roller 15 upward and downward, an electric motor (actuator) forming a drive source for moving this mechanism and its driver, a drive transmission mechanism (belt, pulley or gear, or a suitable combination of same) which transmits the driving force of the motor to the elevator mechanism, a motor forming a driving source for causing the solvent absorbing roller 15 to rotate and its driver, and drive transmission mechanism for same, and the like.

Description of Image Forming Process

Figure 8:
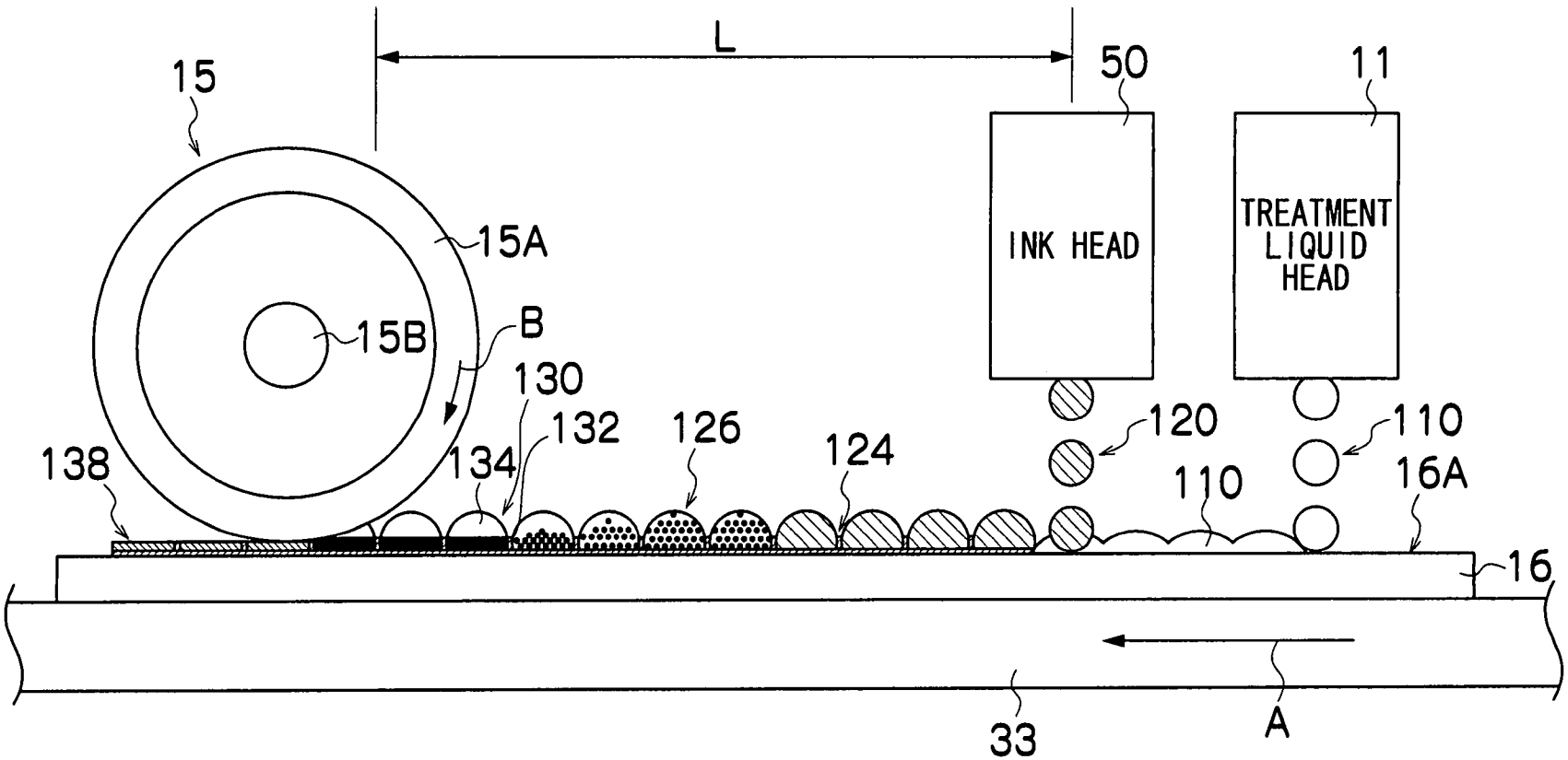
FIG. 8 is a schematic drawing used to describe an image forming process in an inkjet recording apparatus according to the first embodiment.

Next, an image forming process in the inkjet recording apparatus 10 according to the present embodiment is described below. FIG. 8 is an enlarged diagram showing a schematic representation of the principal composition at the periphery of the print unit 12 of the inkjet recording apparatus 10. In FIG. 8, in order to simplify the drawings, only one ink head (print head 50) is shown after the treatment liquid head 11; however, the actual print unit 12 is provided with the four print heads 12K, 12C, 12M, and 12Y, for the four respective colors, as shown in FIG. 1.

In FIG. 8, the recording medium 16 is conveyed from right to left. The image forming process is as described below.

(Step 1)

Treatment liquid 110 is ejected in the form of droplets from the treatment liquid head 11 disposed on the upstream side in terms of the recording medium conveyance direction (the direction of arrow A in FIG. 8), thereby the treatment liquid 110 being applied to the recording surface 16A of the recording medium 16 in advance.

(Step 2)

Ink 120 is ejected in the form of droplets from the print head 50 disposed on the downstream side with respect to the treatment liquid head 11 (i.e., after the treatment liquid head 11), thereby the ink 120 being applied to the recording surface 16A of the recording medium 16 on which the treatment liquid 110 exists.

(Step 3)

The ink 120 is mixed with the treatment liquid 110 on the surface of the recording medium 16, and thereby the cationic polymer in the treatment liquid 110 and the anionic substance in the ink 120 react together and a film 124 forms at the liquid boundary (between the dots, and between the recording medium 16 and the ink 120). This film 124 between dots suppresses unification of the dots and movement of the ink on the recording medium 16. It is possible to reliably prevent the landing interference by rapidly creating the film 124 at the dot boundaries by using the reaction between the cationic polymer and the anionic substance.

(Step 4)

The reaction between the two substances progresses further, and an aggregate (coloring material aggregate) 126 is generated by aggregation of the coloring material in the ink 120. As shown in FIG. 8, the coloring material aggregate 126 sinks downward to the recording medium 16 side. In this way, the liquid droplets (dots) 130 of the ink 120 on the recording medium 16 are separated into a coloring material layer 132 including the coloring material aggregate 126 which has sunk, and a layer of solvent 134.

(Step 5)

With the conveyance of the recording medium 16 (the conveyance in the direction of arrow A in FIG. 8), the liquid droplet 130 that has been separated into the coloring material layer 132 and the solvent 134 is moved to the position of the solvent absorbing roller 15. When the solvent 134 in the liquid droplet 130 comes into contact with the solvent absorbing roller 15, then the solvent 134 is absorbed into the solvent absorbing roller 15 by the capillary force of the porous member 15A. The solvent absorbing roller 15 is rotated in the direction of arrow B in FIG. 8 in accordance with the conveyance speed of the recording medium 16, in such a manner that the relative speed of the roller with respect to the recording medium 16 is zero, thereby preventing disturbance of the image due to rubbing of the ink. Furthermore, in this case, since the polymer film 124 is formed around the periphery of the dots 130, then the movement of the coloring material on the surface of the recording medium 16 is suppressed, and adherence of the coloring material to the solvent absorbing roller 15 is prevented, thereby avoiding disturbance of the image, and the like. More specifically, when the solvent is absorbed by the solvent absorbing roller 15, the film 124 is present between the dots. Hence, this film 124 has the role of suppressing the movement of the ink and preventing disturbance of the image during contact between the solvent absorbing roller 15 and the ink.

The positional relationship between the print head 50 and the solvent absorbing roller 15 (the distance L from the position of the ink landing on the recording medium to the position of the solvent contacting with the roller), and the conveyance speed of the recording medium 16, are set in such a manner that the time period from the landing time of the ink 120 ejected from the print head 50 (in other words, from the mixing time of the two liquids) until the contact time between the solvent 134 and the solvent absorbing roller 15 is longer than the time period taken from the landing time of the ink 120 until the completion time of separation between the coloring material and solvent due to the two-liquid reaction.

(Step 6)

In the ink from which the solvent has been removed by the solvent absorbing roller 15 in this way (reference numeral 138 in FIG. 8), the coupling force between the coloring material bodies increases, and the coloring material becomes fixed onto the recording medium 16. Thereby, the occurrence of bleeding is prevented, and furthermore, beneficial effects are obtained in that bleeding between colors is prevented, drying and fixing are promoted, and cockling is avoided, and the like.

Second Embodiment

Figure 9:
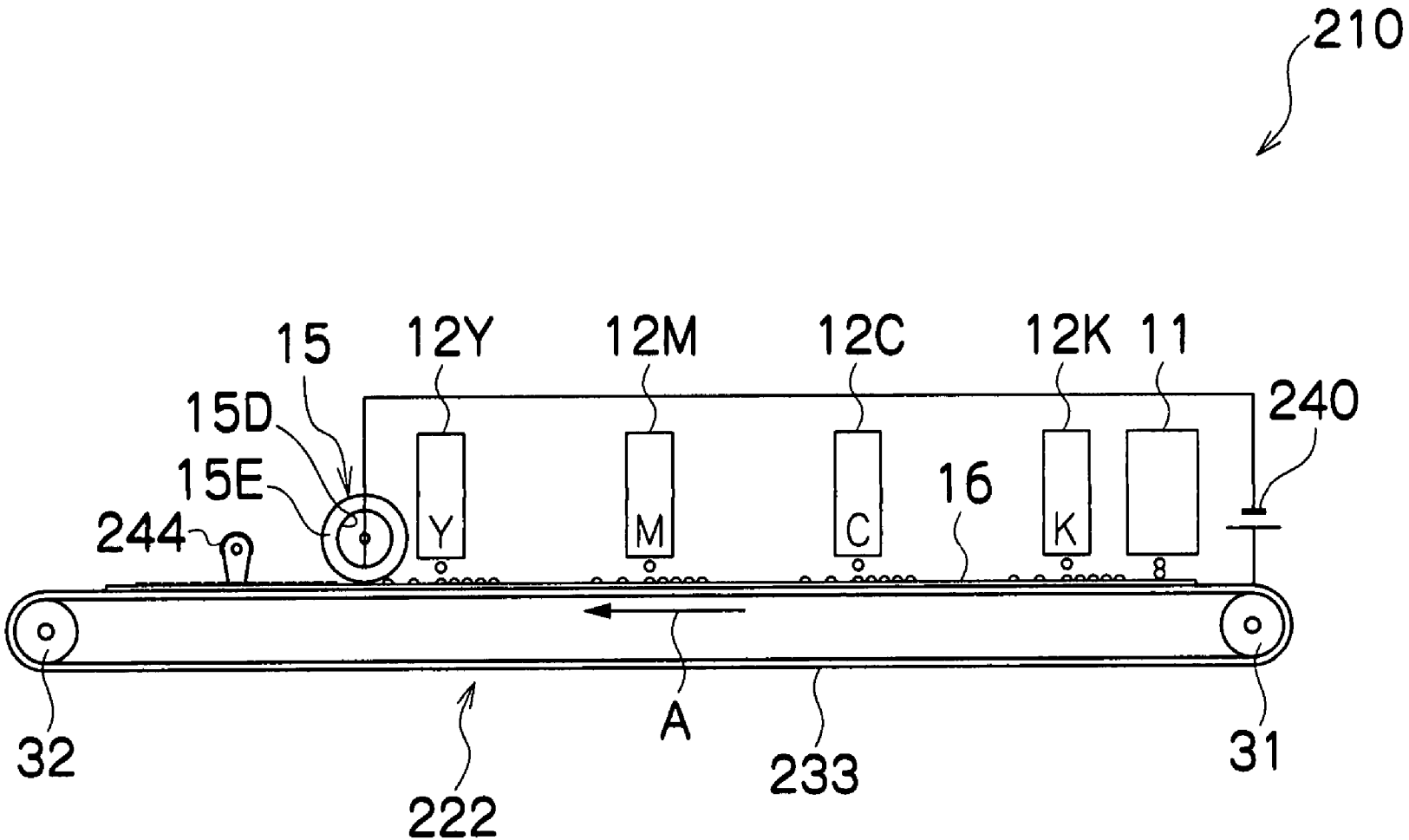
FIG. 9 is a schematic drawing showing the principal composition of an inkjet recording head according to a second embodiment of the present invention.

FIG. 9 is a schematic drawing showing the principal composition of an inkjet recording head according to a second embodiment of the present invention. In FIG. 9, members which are the same as or similar to the composition in FIG. 1 are labeled with the same reference numerals and description thereof is omitted here.

The composition of the treatment liquid and ink used in the inkjet recording apparatus 210 shown in FIG. 9 is similar to the composition shown in FIG. 1. However, the treatment liquid in this embodiment is a liquid which, by being mixed with the ink, causes a reaction whereby the coloring material aggregate is charged either positively or negatively (in the present example, negatively) as well as generates aggregate of the coloring material.

As means for applying charge to the aggregate of the coloring material, there are methods such as adjusting the composition of the ink or treatment liquid in such a manner that an anionic or cationic base remains on the surface of the aggregate of the coloring material during anionic/cationic reaction, or controlling the surface electric potential of the pigment by adjusting pH.

The media conveyance unit 222 in the inkjet recording apparatus 210 has a structure in which an endless conveyance belt (electrostatic attraction belt) 233 is wound between two rollers 31 and 32.

The conveyance belt 233 is made of a conducting member, and is electrically connected to a DC (Direct Current) power supply (corresponding to a voltage application device) 240. The other end (negative electrode) of the DC power supply 240 is electrically connected to the solvent absorbing roller 15. When a DC voltage is applied to the conveyance belt 233 by the DC power supply 240, the recording medium 16 is attracted to and held on the conveyance belt 233 because of an electrostatic attraction effect.

The solvent absorbing roller 15 has a structure in which a thin porous member 15E is formed on the surface of a metal roller 15D (see FIG. 10), and a negative voltage (a voltage of the same polarity as the coloring material aggregate) is applied to the solvent absorbing roller 15 by the DC power supply 240, as shown in FIG. 9.

An infrared heater 244 forming a device for promoting the drying of the recording surface (a drying promotion device) is disposed after the solvent absorbing roller 15.

Figure 10:
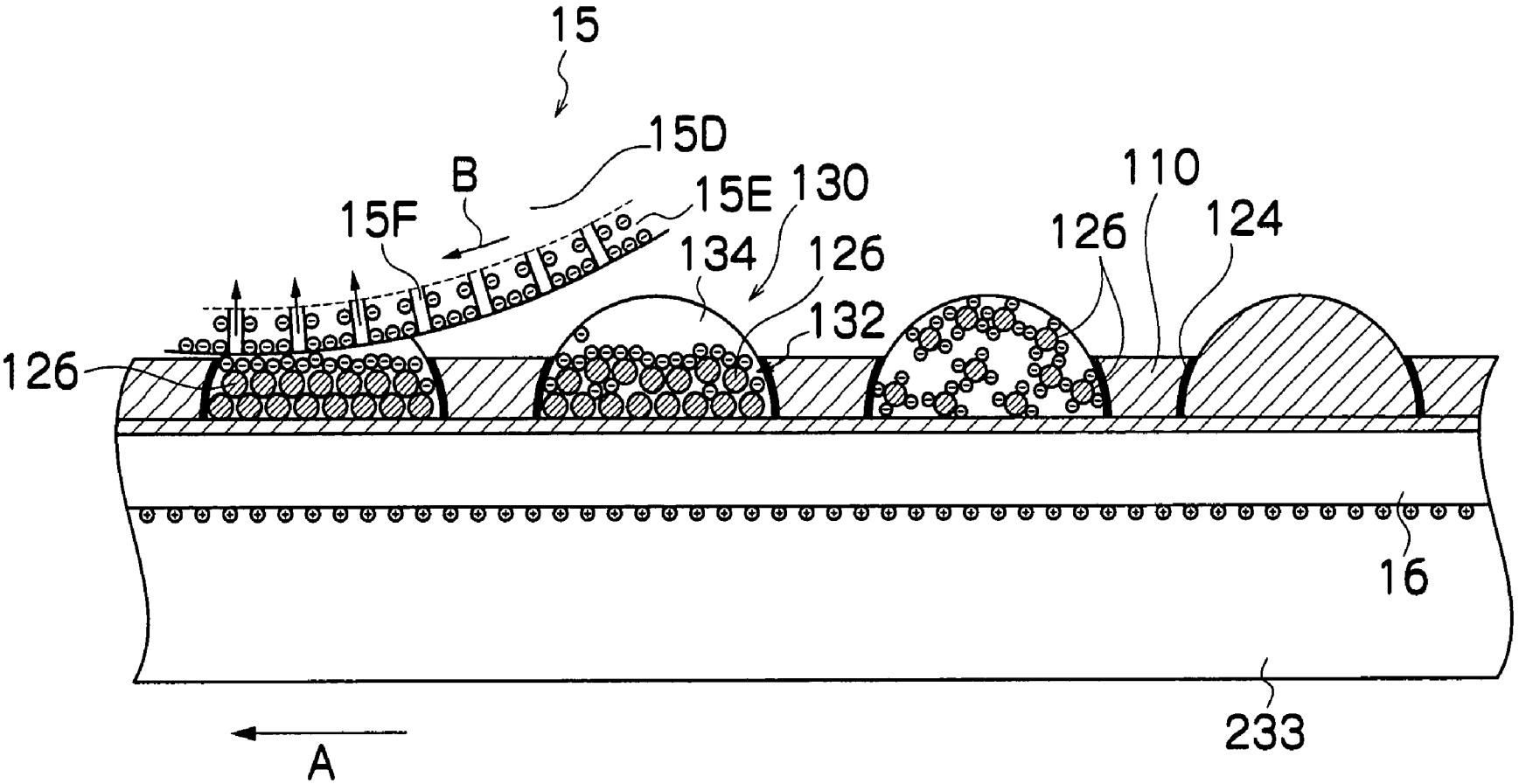
FIG. 10 is an enlarged view of a mixed liquid on the recording medium.

Next, a two-liquid reaction between the ink and the treatment liquid in the composition shown in FIG. 9 is described with reference to FIG. 10. FIG. 10 is a schematic drawing showing an enlarged view of the mixed liquid on the recording medium 16.

When a droplet of the ink is deposited onto the treatment liquid, a film 124 is formed at the liquid interface due to the reaction between the two liquids, as described in FIG. 8. Due to the formation of this film 124, landing interference is prevented. Furthermore, a negatively charged coloring material aggregate is generated in the ink droplet on the recording medium 16, as indicated by reference numeral 126 in FIG. 10. The coloring material aggregate 126 sinks downward to the recording medium 16 side, and the droplet (dot) 130 on the recording medium 16 separates into a coloring material layer 132 including the coloring material aggregate 126 which has sunk, and a layer of solvent 134.

The surface of the conveyance belt 233 which supports the recording medium 16 from the rear side thereof (in other words, the surface of the conveyance belt 233 which makes contact with the recording medium 16) is charged to the opposite polarity to the coloring material aggregate 126 (in the case of the present example, it is charged positively). Therefore, an electrostatic force of attraction acts so as to draw the negatively charged coloring material aggregate 126 toward the conveyance belt 233, thereby promoting the sinking of the coloring material aggregate 126 yet further, and hence the coloring material (coloring material aggregate 126) and the solvent 134 can be reliably separated into two layers, in a short period of time.

The solvent absorbing roller 15 has the structure in which the thin porous member 15E is provided on the surface of the metal roller 15D. The solvent absorbing roller 15 is disposed in such a manner that a very small gap is formed between the bottommost part of the solvent absorbing roller 15 and the recording medium 16. The solvent absorbing roller 15 makes contact with the layer of solvent 134 on the recording medium 16 while rotating in the direction of arrow B in FIG. 10. As shown in FIG. 10, the solvent 134 that makes contact with the solvent absorbing roller 15 is absorbed by the porous member 15E by the capillary action.

The solvent absorbing roller 15 is charged to the same polarity as the coloring material aggregate 126 on the recording medium 16 (in the present example, it is negatively charged), and hence an electrostatic force of repulsion acts on the coloring material aggregate 126 in a direction away from the porous member 15E. Therefore, it is possible to prevent the coloring material aggregate 126 from adhering to the surface of the porous member 15E while the porous member 15E absorbs the solvent 134.

Furthermore, as stated above, the conveyance belt 233 is charged to the opposite polarity to that of the coloring material aggregate 126 (in the present example, it is charged positively), and hence an effect of suppressing the movement of the coloring material aggregate 126 toward the solvent absorbing roller 15 is obtained while the solvent 134 is absorbed by the porous member 15E, thereby making it possible to prevent the adherence of the coloring material aggregate 126 to the surface of the porous member 15E more effectively.

Moreover, the diameter of each pore 15F in the porous member 15E is desirably set to be sufficiently smaller than the particle diameter of the coloring material aggregate 126. According to this composition, due to the filtering effect of the porous member 15E, the penetration of the coloring material aggregate 126 into the pores 15F of the porous member 15E is prevented. Therefore, it is possible to prevent the coloring material aggregate 126 from being absorbed into the porous member 15E together with the solvent 134.

Although a negatively charged coloring material aggregate 126 is generated in the embodiment shown in FIG. 9 and FIG. 10, a mode where the coloring material aggregate is positively charged is also possible.

As described above, the coloring material and the solvent are reliably separated by generating a coloring material aggregate charged either positively or negatively by means of a two-liquid reaction between the ink and the treatment liquid. Moreover, the conveyance belt 233 that supports the recording medium 16 is set to an electric potential of the opposite polarity to the coloring material aggregate 126, and the solvent absorbing roller 15 forming the solvent removing device is set to an electric potential of the same polarity as the coloring material aggregate 126. Thus, it is possible to effectively promote the separation between the coloring material and the solvent by the sinking of the coloring material, thereby preventing movement of the coloring material and absorbing the solvent 134 swiftly and reliably.

Third Embodiment

Figure 11:
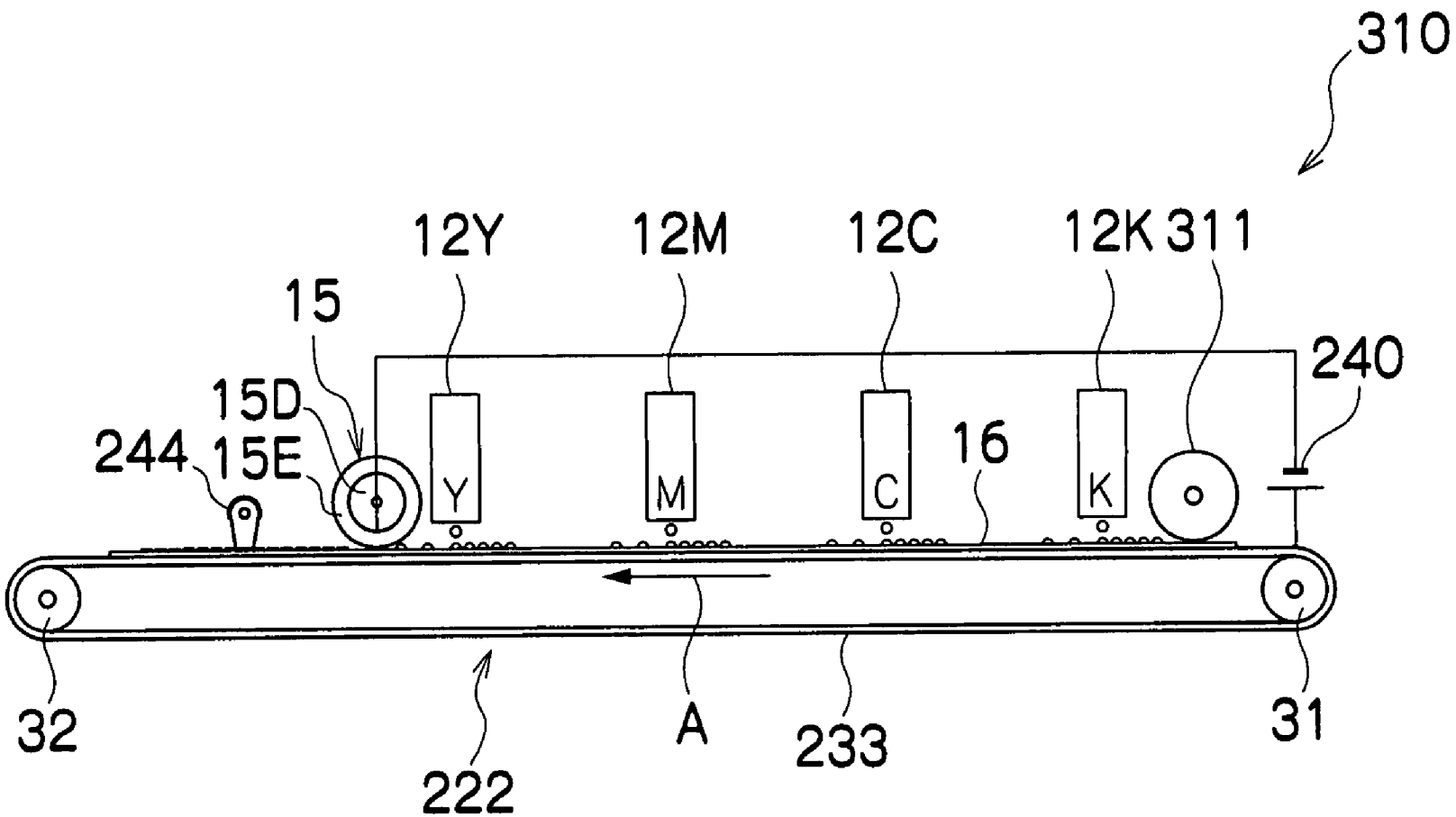
FIG. 11 is a schematic drawing showing the principal composition of an inkjet recording head according to a third embodiment of the present invention.

FIG. 11 is a schematic drawing showing the principal composition of an inkjet recording head according to a third embodiment of the present invention. In FIG. 11, members which are the same as or similar to the composition in FIG. 9 are labeled with the same reference numerals and description thereof is omitted here.

While the inkjet recording apparatus 210 according to the second embodiment shown in FIG. 9 is provided with the inkjet type treatment liquid head 11 as the treatment liquid application device, the inkjet recording apparatus 310 according to the third embodiment shown in FIG. 11 is provided with a treatment liquid application roller 311 as the treatment liquid application device.

The treatment liquid application roller 311 may achieve a length corresponding to the full width of the recording medium 16 by means of one (a single) long roller member, and may also achieve the required length by aligning a plurality of roller modules divided in a direction (main scanning direction) substantially perpendicular to the conveyance direction of the recording medium 16. Furthermore, it is possible to adopt a composition in which a plurality of rows of treatment liquid application rollers are disposed in line with the conveyance direction of the recording medium 16.

Although not shown in FIG. 11, an elevator mechanism for raising and lowering the treatment liquid application roller 311 with respect to the recording medium 16 is provided. By controlling the elevator mechanism in accordance with instructions from the system controller, the position of the treatment liquid application roller 311 (the relative position thereof in the direction perpendicular to the recording surface of the recording medium 16) can be adjusted. Hence, it is possible to alter the contact pressure with respect to the recording medium 16 and the clearance with respect to the recording medium 16, by using the above elevator mechanism. In the case of a composition having a plurality of roller modules, a desirable mode is one in which a mechanism for controlling the vertical position is provided with respect to each roller module.

The treatment liquid application roller 311 is made of a porous member. The treatment liquid application roller 311 is composed in such a manner that the treatment liquid is applied to a prescribed region of the recording medium 16 (all or a portion of the recording medium), by moving the recording medium 16 in the paper feed direction while the treatment liquid application roller 311 impregnated with the treatment liquid is caused to make contact with the recording medium 16.

Although a porous member is used as the treatment liquid application roller 311 in the present embodiment, it is also possible, for example, to use a treatment liquid application device having a structure in which treatment liquid is caused to flow onto the recording medium 16 via an application roller made of a rubber member, or the like, while the application roller is caused to rotate in a prescribed direction.

If a composition which applies the treatment liquid by means of the treatment liquid head (ejection head) as shown in FIG. 1 and FIG. 9 is adopted, then it is possible to apply the treatment liquid selectively to the required regions of the recording medium (for example, only to the regions to be printed with ink), on the basis of the image data. Therefore, the amount of treatment liquid consumed can be reduced in comparison with an application device based on a roller, or the like.

On the other hand, a device which applies the treatment liquid by using a member such as the treatment liquid application roller 311 as shown in FIG. 11 has merits in that it enables handling of a liquid of high degree of viscosity that it is difficult to eject by means of the inkjet ejection head, and also enables a large amount of liquid to be applied in a short period of time.

Fourth Embodiment

Figure 12:
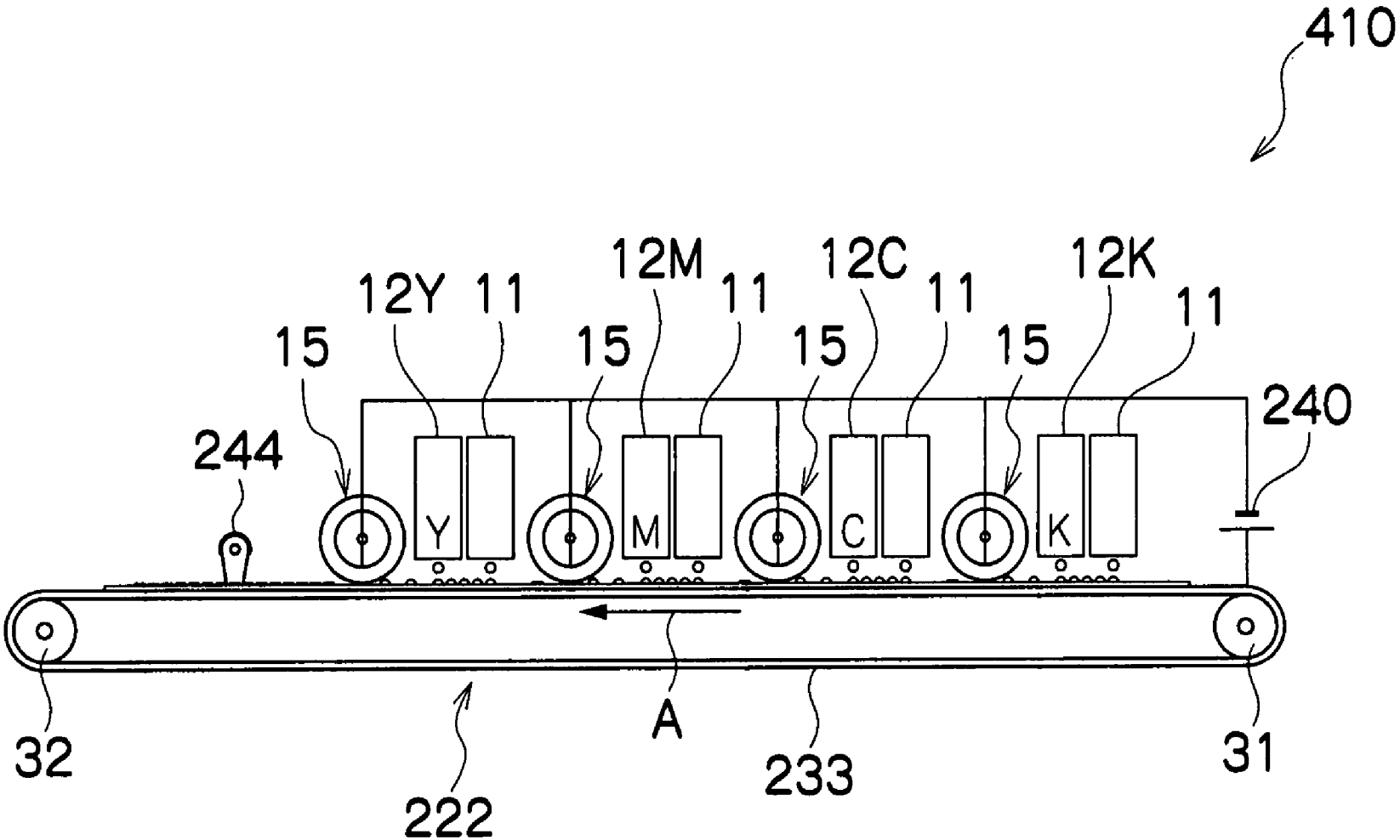
FIG. 12 is a schematic drawing showing the principal composition of an inkjet recording apparatus according to a fourth embodiment of the present invention.

FIG. 12 is a schematic drawing showing the principal composition of an inkjet recording head according to a fourth embodiment of the present invention. In FIG. 12, members which are the same as or similar to the composition in FIG. 9 are labeled with the same reference numerals and description thereof is omitted here.

The inkjet recording apparatus 210 according to the second embodiment shown in FIG. 9 has a composition in which the treatment liquid head 11 is disposed only on the upstream side (the right-hand side in FIG. 9) with respect to the print head 12K in terms of the paper conveyance direction (i.e., before the print head 12K). In contrast, in the inkjet recording apparatus 410 according to the fourth embodiment shown in FIG. 12, the treatment liquid head 11 is disposed on the upstream side with respect to each of the print heads 12K, 12M, 12C, and 12Y (before each print head), and a solvent absorbing roller 15 is disposed on the downstream side with respect to each of the print heads 12K, 12M, 12C, and 12Y (after each print head). According to this composition, it is possible to apply a suitable amount of treatment liquid for each color of ink as well as remove the solvent.

Although the embodiments in the foregoing description are described in which the ink droplets are ejected after applying the treatment liquid, it is also possible to adopt a composition in which droplets of the treatment liquid are ejected after ejecting droplets of the ink, and a composition in which droplets of the treatment liquid and ink are ejected substantially simultaneously onto the same droplet ejection positions on the recording medium 16.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a treatment liquid application device which applies treatment liquid onto a recording medium, the treatment liquid containing cationic polymer and a coloring material aggregating agent;

an ink liquid ejection device which ejects droplets of ink liquid toward the treatment liquid on the recording medium so as to form a polymer film at a liquid interface between the treatment liquid and the ink liquid, the ink liquid having anionic properties and containing a solvent and a coloring material which aggregates due to reaction with the coloring material aggregating agent; and a solvent absorbing device which absorbs the solvent on the recording medium in a state where an aggregate of the coloring material and the solvent are separated after a first reaction in which the polymer film is formed at the liquid interface between the treatment liquid and the ink liquid on the recording medium by mixing the treatment liquid and the ink liquid and a second reaction in which the aggregate of the coloring material in the ink liquid is formed after formation of the polymer film, wherein;

the polymer film which is formed in the first reaction isolates the droplets on the ink liquid on the recording medium from each other and thereby prevents unification of mutually adjacent dots formed by the droplets of the ink liquid on the recording medium; and the second reaction progresses within each of the droplets of the ink liquid having been isolated from each other by the polymer film.

2. The image forming apparatus as defined in claim 1, wherein the solvent absorbing device has a surface made of a porous member.

3. The image forming device as defined in claim 1, further comprising a conveyance device which conveys at least one of the ink liquid ejection device and the recording medium in such a manner that the recording medium is relatively moved in a relative movement direction with respect to the ink liquid ejection device, wherein:

the treatment liquid application device, the ink liquid ejection device, and the solvent absorbing device are disposed in this order, from an upstream side to a downstream side in the relative movement direction; and the ink liquid ejection device and the solvent absorbing device are disposed a required distance apart in such a manner that a time period from landing time of the ink liquid on the recording medium until contact time between the solvent of the ink liquid and the solvent absorbing device, is greater than a time period from the landing time of the ink liquid on the recording medium until completion time of separation of the coloring material and the solvent by the second reaction, when the recording medium is relatively moved with respect to the ink liquid ejection device at a prescribed relative speed by the conveyance device.

4. The image forming apparatus as defined in claim 1, further comprising a first voltage application device which applies a first voltage to the solvent absorbing device, wherein:

the aggregate of the coloring material is charged by reaction between the treatment liquid and the ink liquid; and the first voltage application device applies the first voltage of same polarity as that of the aggregate of the coloring material, to the solvent absorbing device.

5. The image forming apparatus as defined in claim 4, further comprising:

a medium supporting member which supports the recording medium from a face on opposite side to a recording face of the recording medium; and a second voltage application device which applies a second voltage of opposite polarity to that of the aggregate of the coloring material, to the medium supporting member.

6. An image forming method, comprising the steps of:

applying treatment liquid containing cationic polymer and a coloring material aggregating agent, onto a recording medium;

ejecting droplets of ink liquid toward the treatment liquid on the recording medium so as to form a polymer film at a liquid interface between the treatment liquid and the ink liquid, the ink liquid having anionic properties and containing a solvent and a coloring material which aggregates due to reaction with the coloring material aggregating agent;

performing a first reaction in which the polymer film is formed at the liquid interface between the treatment liquid and the ejected ink liquid on the recording medium, by mixing the treatment liquid and the ejected ink liquid, the polymer film isolating the droplets of the ink liquid on the recording medium from each other and thereby preventing unification of mutually adjacent dots formed by the droplets of the ink liquid on the recording medium;

performing a second reaction in which an aggregate of the coloring material in the ink liquid is formed within each of the droplets of the ink liquid having been isolated from each other by the polymer film on the recording medium; and absorbing the solvent on the recording medium by means of an absorbing member in a state where the aggregate of the coloring material and the solvent are separated after the first reaction and the second reaction.

* * * * *